US011828114B2

(12) United States Patent
Panda et al.

(10) Patent No.: US 11,828,114 B2
(45) Date of Patent: Nov. 28, 2023

(54) COLD SPRAYING A COATING ONTO A ROTOR IN A DOWNHOLE MOTOR ASSEMBLY

(71) Applicant: Halliburton Energy Services, Inc., Houston, TX (US)

(72) Inventors: Krutibas Panda, Houston, TX (US); Philip Park Hung Leung, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 56 days.

(21) Appl. No.: 17/563,387

(22) Filed: Dec. 28, 2021

(65) Prior Publication Data

US 2023/0203895 A1 Jun. 29, 2023

(51) Int. Cl.

| | |
|---|---|
| ***E21B 4/02*** | (2006.01) |
| ***E21B 17/10*** | (2006.01) |
| ***E21B 4/00*** | (2006.01) |

(52) U.S. Cl.

CPC ..... *E21B 17/1085* (2013.01); *E21B 4/003* (2013.01); *E21B 4/02* (2013.01)

(58) Field of Classification Search

CPC ..... E21B 17/1085; E21B 4/003; E21B 4/02

See application file for complete search history.

(56) References Cited

U.S. PATENT DOCUMENTS

| | | | | |
|---|---|---|---|---|
| 4,592,964 | A | 6/1986 | Bueran et al. | |
| 5,302,414 | A * | 4/1994 | Alkhimov | B05B 7/1486 427/195 |
| 6,780,458 | B2 * | 8/2004 | Seth | F01D 5/288 427/205 |
| 8,703,233 | B2 | 4/2014 | Miller et al. | |

(Continued)

FOREIGN PATENT DOCUMENTS

| | | |
|---|---|---|
| EP | 2175050 A1 | 4/2010 |
| WO | 2013032626 | 3/2013 |
| WO | 2015168481 | 11/2015 |

OTHER PUBLICATIONS

Moridi et al., "Cold spray coating: review of material systems and future perspectives", Surface Engineering, vol. 36, No. 6, 2014, pp. 369-395.

(Continued)

*Primary Examiner* — Taras P Bemko

(74) *Attorney, Agent, or Firm* — Kilpatrick Townsend & Stockton LLP

(57) ABSTRACT

Systems and methods for cold-spraying coatings on rotors in motor assemblies for improving reliability of motor assembly use downhole in wellbores is provided. For example, a motor assembly can include a stator positioned downhole in a wellbore and rotor coupled to the wellbore. The rotor can include a base material and a first coating deposited onto the base material via cold spraying for reducing damage to the rotor. The first coating may include sprayed particles that have a melting point temperature that is higher than a (Continued)

temperature of a gas used in the cold spraying. In some examples, the rotor may include a second coating deposited onto the first coating via cold spraying, high velocity oxygen fuel coating, or high velocity air fuel. The first coating may have a first hardness that is less than a second hardness of the second coating.

20 Claims, 3 Drawing Sheets

(56) References Cited

U.S. PATENT DOCUMENTS

| | | | | |
|---|---|---|---|---|
| 8,800,848 | B2 | 8/2014 | Mirchandani et al. | |
| 9,790,375 | B2 | 10/2017 | Xu et al. | |
| 10,407,776 | B2 * | 9/2019 | Kang | C23C 4/129 |
| 10,508,492 | B2 * | 12/2019 | Barnard | F04C 2/1075 |
| 11,131,144 | B1 * | 9/2021 | Althowiqeb | E21B 31/035 |
| 2008/0164070 | A1 | 7/2008 | Keshavan et al. | |
| 2010/0038142 | A1 * | 2/2010 | Snyder | F04C 2/1071 175/57 |
| 2010/0251962 | A1 * | 10/2010 | Fukanuma | B05B 7/1404 118/302 |
| 2012/0018227 | A1 * | 1/2012 | Puzz | F04C 2/1075 51/297 |
| 2013/0048384 | A1 | 2/2013 | Jarvis et al. | |
| 2013/0048701 | A1 * | 2/2013 | Mirchandani | C23C 26/00 228/121 |
| 2014/0054091 | A1 | 2/2014 | Barnard | |
| 2014/0151596 | A1 | 6/2014 | Hirsch | |
| 2015/0192123 | A1 * | 7/2015 | Lehr | F04C 2/1071 418/191 |
| 2016/0279703 | A1 | 9/2016 | Clare et al. | |
| 2018/0238114 | A1 * | 8/2018 | Huber | F04C 2/1075 |
| 2021/0310333 | A1 * | 10/2021 | Althowiqeb | E21B 17/22 |

OTHER PUBLICATIONS

PCT/US2021/065310, "International Search Report and the Written Opinion", dated Sep. 15, 2022, 9 pages.

* cited by examiner

COLD SPRAYING A COATING ONTO A ROTOR IN A DOWNHOLE MOTOR ASSEMBLY

TECHNICAL FIELD

The present disclosure relates generally to wellbore drilling operations and, more particularly (although not necessarily exclusively), to depositing coatings via cold spraying onto rotors in motor assemblies used in wellbore drilling operations.

BACKGROUND

A downhole motor, such as a positive displacement mud motor, may utilize fluid energy converted to mechanical energy to provide shaft rotation to a drill string or drill bit. The downhole motor may include a power section having a rotor operating within a stator. The fluid energy can be provided from drilling fluid that flows in a cavity between the stator and the rotor. The cavity may be filled with the incompressible drilling fluid that may transmit torque under pressure to provide mechanical energy. The stator may be made of an elastomeric material. The rotor may include a coating to protect the rotor material from the drilling fluid.

For example, the coating may be deposited onto a base material of the rotor via hard chrome plating. In some examples, the coating may experience corrosion from the drilling fluid, causing the coating to flake off and expose the base material of the rotor to the drilling fluid. In some examples where the base material has been damaged due to corroded coating, the base material may be repaired via high heat spot weld repair. The weld repair may be coated with additional hard chrome coating. Repeated additional coatings may have higher thicknesses, which may cause the coating to be more prone to stress cracking. Additionally, repeated additional welding and coating may change the profile of the rotor, which may cause premature chunking of the elastomeric material of the stator.

In other examples, the coating may be deposited onto the base material via high-velocity air fuel (HVAF) spraying or high velocity oxygen fuel (HVOF) spraying. HVAF or HVOF sprayed coating may have better corrosion resistance than hard chrome plated coating, but may be more prone to stress cracking. Similar to hard chrome plated coating, HVAF or HVOF sprayed coating may have higher coating thicknesses with repeated repairs. Thicker coatings may be more susceptible to cracking.

DETAILED DESCRIPTION

Figure 1:
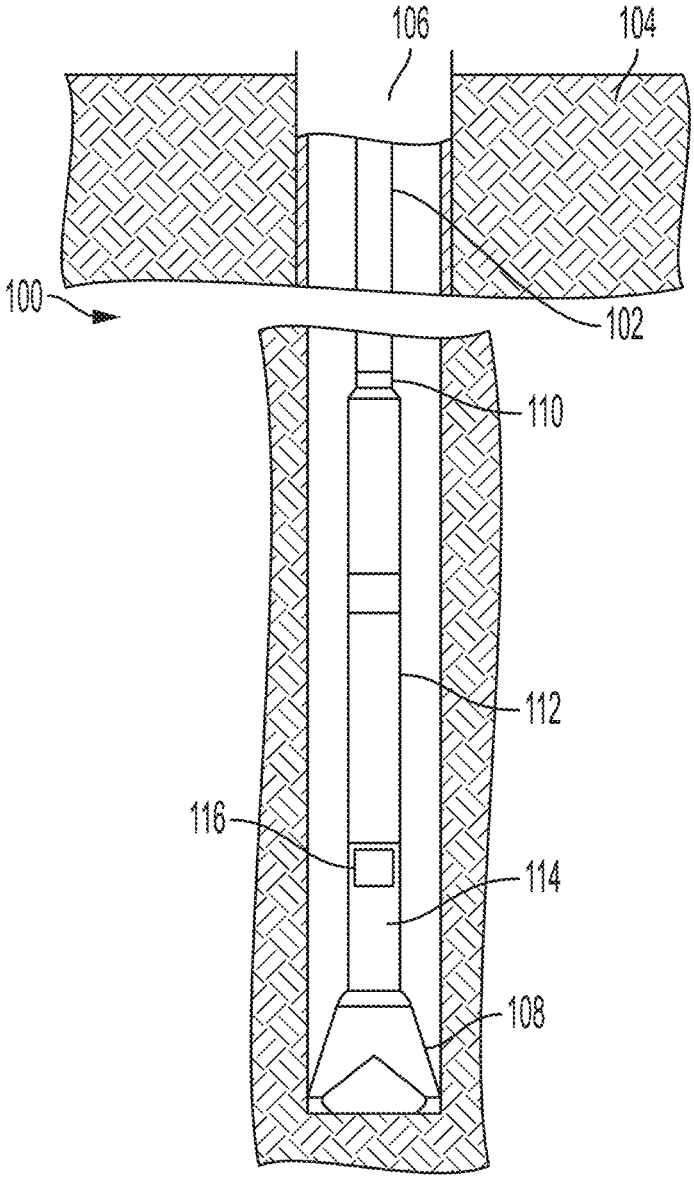
FIG. 1 is a cross-sectional schematic diagram depicting a drilling system that includes a motor assembly according to one example of the present disclosure.

Certain aspects and examples of the present disclosure relate to depositing a coating onto a rotor in a downhole motor assembly via cold spraying to improve the reliability and corrosion resistance of the rotor. Rotors may rotate within stators of motor assemblies to generate power for drilling operations, such as drilling a wellbore. Cold spraying is a thermal spraying process that can include depositing solid powder particles onto a material at relatively high speeds and at temperatures below a melting point temperature of the solid powder particles. Unlike other deposition techniques, the solid powder particles may be deposited onto and may adhere to a base material of the rotor without being melted.

Coatings that are cold sprayed onto the base material of the rotor may have improved bond strength compared to coatings deposited via other deposition processes. Other deposition processes can include hard chrome plating or thermal processes including high velocity oxygen fuel (HVOF) spraying or high velocity air fuel (HVAF) spraying. Additionally, cold sprayed coatings may have higher corrosion resistance to saturated brine and water-based drilling fluids than coatings deposited via other deposition processes. The cold sprayed coatings may have improved resistance to cracking, while still having a higher corrosion resistance. In some examples, the coating may have a similar or comparable stiffness to the stiffness of the base material of the rotor. The similar or comparable stiffness of the coating may increase the durability of the rotor. In some examples, the coating may be able to extract heat away from the stator, which may prevent or reduce chunking of the elastomeric material of the stator. Additionally, the cold sprayed coating may provide an improved friction coefficient between the hard coating of the rotor and the compressible elastomeric material of the stator. By reducing cracking and corrosion of the coating and improving reliability of the rotor via cold spraying of the coating, damage to power sections of downhole motor assemblies may be decreased, increasing the lifespan of the downhole motor assemblies. Non-productive time associated with repairing damaged sections of rotors or stators can be reduced or eliminated.

Because the coating is cold sprayed onto the base material of the rotor at temperatures below the melting point of the sprayed solid powder particles, the original properties of the solid powder particles can be retained. This differs from HVOF spraying and HVAF spraying, during which high temperatures can significantly alter the state and properties of solid powder particles. Therefore, phenomena such as oxidation, thermal residual stresses, and phase transformations that are inherent limitations to HVOF spraying and HVAF spraying can be avoided considerably. The high speeds at which the solid powder particles are sprayed onto the rotor can create significantly denser coatings, which can reduce or eliminate voids in the coating. Due to the relatively low temperature of the cold spraying, a wide selection of coating materials can be cold sprayed onto the rotor. The coating materials may be selected to enhance the hardness, toughness, stiffness, corrosion resistance, wear resistance, and other properties of the rotor.

In one particular example, a rotor may include a single coating deposited via cold spraying onto a base material of the rotor. The coating may be a composite material. In some examples, additives can be incorporated into the coating or can be cold sprayed substantially contemporaneously with the cold spraying of the coating. Using cold spraying, the additives can be incorporated without significant degradation of their properties. For example, the additives can include solid lubricants for reducing friction between the rotor and the stator. Reducing friction between the rotor and stator may reduce chunking of the stator. Alternatively or additionally, the additives can include conducting materials for increasing thermal conductivity of the rotor. The conducting materials may additionally reduce hysteresis damage of the elastomeric material of the stator.

In some examples, a rotor may include multiple coatings deposited via cold spraying onto a base material of the rotor. For example, the rotor may include a first coating deposited onto the base material and a second coating deposited onto the first coating. The first coating may be a softer material that is relatively corrosion resistant, and the second coating may be a harder material that is relatively wear-resistant. The first coating may be deposited via cold spraying and the second coating may be deposited via cold spraying, HVOF spraying, or HVAF spraying. This can ensure low heat input on the base material and lower thermal stress on the first coating by minimizing the thickness of the second coating. The softer first coating may additionally enhance the anchoring of the second coating to the rotor. The combination of the first coating and the second coating may significantly reduce or eliminate the need for rotor repair, as the base material may be less likely to come into contact with corrosive drilling fluids.

In some examples, rotors may be repaired by depositing a coating via cold spraying on top of coatings that were not previously cold sprayed, such as hard chrome plated rotors or HVOF/HVAF sprayed rotors. The repair coating may be cold sprayed with a non-uniform profile in particular areas of concern, which may allow for higher thickness of the overall coating without the risk of introducing cracking or thermal residual stresses. This may increase the amount of motor assemblies that can be repaired, as rotors that may have been scrapped due to damage that would otherwise require repairs exceeding thickness limitations for chrome plating or HVOF spraying can be repaired using cold spraying. Thickness limitations for hard chrome plating can be up to 0.030" and for HVOF/HVAF spraying can be up to 0.010". Coatings deposited via cold spraying may have higher thickness limitations.

After coating rotors can be polished to decrease friction between the rotor and stator. In some examples, the coating may be a nanostructured material that includes relatively small particles. Cold spraying relatively small particles onto the rotor may decrease or eliminate the need for polishing the rotor. Examples of motor assemblies including cold sprayed rotors can include positive displacement rotors. Additionally, components of progressive cavity pumps may also be cold sprayed with coatings to protect from corrosion or damage due to drilling fluids.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional schematic diagram depicting a drilling system 100 that includes a motor assembly 114 according to one example of the present disclosure. The drill string 102 of a drilling rig (not shown) may include segmented pipes that may extend below the surface 104 in a borehole, such as the wellbore 106. The drill string 102 may transmit drilling fluid (or mud) and the torque necessary to operate a drill bit 108. Also, the weight of the drill string 102 may provide an axial force on the drill bit 108. The drill string 102 may include a drill pipe 110 and a bottom hole assembly 112. The bottom hole assembly 112 may include various components, such as the downhole motor assembly 114 and the drill bit 108 at a downhole end of the drill string 102. In some aspects, the downhole motor assembly 114 may include a downhole motor having a power section. The power section may include a rotor housed in a stator. The rotor may be connected to the drill bit via a driveshaft. The catch assembly 116 can catch portions of the downhole motor assembly 114 in the event of a failure.

Figure 2:
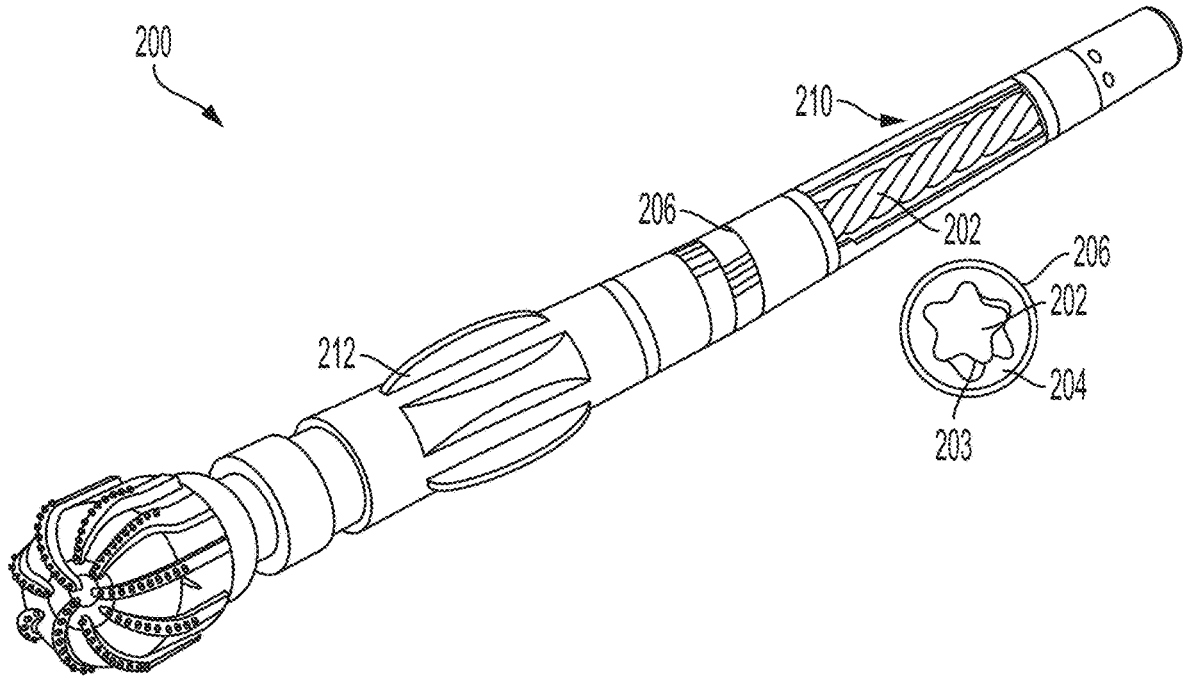
FIG. 2 is a diagram of a motor assembly including a rotor and a stator according to one example of the present disclosure.

FIG. 2 is a diagram of a motor assembly 200 including a rotor 202 and a stator 204 according to one example of the present disclosure. In some examples, the motor assembly 200 may be a positive displacement mud motor. The rotor 202 may be positioned within the stator 204. The stator 204 may be positioned within a housing 206 of a power section 210 of the motor assembly 200. In some examples, the motor assembly 200 may additionally include a near bit stabilizer 212 for stabilizing the motor assembly 200.

The profile arrangement of the rotor 202 and stator 204 may be similar to a gear, where the rotor 202 has one less lobe than the stator 204. This may cause a cavity between the rotor 202 and the stator 204. Drilling fluid may flow through the cavity that when pressurized, may provide torque for turning the rotor 202 within the stator 204. The turning of the rotor 202 may power the motor assembly 200. The stator 204 may be an elastomeric material such as a rubber. The rotor 202 may include a base material and a coating 203 that may be deposited onto the base material via cold spraying. In some examples, the base material may be a hard metal material such as 17-4 PH stainless steel.

In some examples, the rotor 202 may include multiple coatings 203 on the base material. Each coating 203 may have varying properties that, when combined or layered, may increase the longevity and durability of the rotor 202. For example, the rotor 202 may include a first coating cold sprayed onto the base material and a second coating deposited onto the first coating. Examples of the first coating can include anti-corrosion-resistant materials such as alloy 625, C276, alloy 925, or other similar corrosion-resistant materials in the nickel or titanium family. The second coating may be a harder anti-wear composite material. Examples of the second coating can include a ceramic metal matrix composite, such as a tungsten carbide and chromium carbide based composite. In some examples, a binder or matrix of the second coating can be a metal alloy such as a nickel chromium boron alloy. The thickness of the second coating may be less than a thickness of the first coating. The first coating may be a softer material than the second coating, which may enhance the anchoring of the harder second coating to the first coating. Including two coatings on the base material of the rotor 202 may significantly reduce the likelihood of corrosion or damage to the base material due to the relatively high corrosion resistance, ductility, and toughness of the combined coatings.

In some examples, a single coating may be deposited onto the base material via cold spraying. The single coating may be a composite material such as a ceramic metal matrix composite. For example, the ceramic metal matrix composite may be a tungsten carbide and chromium carbide based composite with an alloyed mixture such as nickel chromium boron alloy. In some examples, the single coating may be a titanium alloy or a nickel alloy. In some examples, the single coating may be mixed with or co-deposited with an additive such as a solid lubricant or a conducting material. Examples of solid lubricants can include tungsten sulfide, tungsten disulfide, molybdenum disulphide, boron nitride, graphite, or other similar lubricating materials. The solid lubricants can aid in reducing friction between the rotor 202 and the stator 204. Examples of conducting materials can include copper, silver, graphene, carbon nanotube, or other similar conducting materials. The conducting materials may aid in reducing thermal hysteresis damage of the elastomeric material of the stator 204 by conducting the heat away from the elastomeric material. In some examples, the additives may be incorporated into multiple coatings onto the base material.

In some examples, the conducting materials may comprise from 1.0% by weight to 5.0% by weight of the coating 203. For example, the conducting materials may comprise, by weight, from 1.0% to 2.0%, from 2.0% to 3.0%, from 3.0% to 4.0%, or from 4.0% to 5.0% of the coating 203. In some examples, the solid lubricants may comprise from 1.0% by weight to 10.0% by weight of the coating 203. For example, the solid lubricants may comprise, by weight, from 1.0% to 2.0%, from 2.0% to 3.0%, from 3.0% to 4.0%, from 4.0% to 5.0%, from 5.0% to 6.0%, from 6.0% to 7.0%, from 7.0% to 8.0%, from 8.0% to 9.0%, or from 9.0% to 10.0% of the coating 203.

In some examples, a damaged rotor 202 may be repaired via coatings that are cold sprayed. Rather than chemically stripping the former coating, which may remove portions of the base material and thus require thicker repair coating, cold sprayed coatings may be applied to repair the rotor 202. Cold sprayed coatings may not have the same thickness limitations or weaknesses of hard chrome plating or HVOF/HVAF sprayed coatings. Cold sprayed coatings may be used to repair damaged rotors 202 without the risk of introducing cracking or thermal residual stresses. For example, a rotor 202 with hard chrome plating that has experienced damage may be cold sprayed with a coating to repair and reinforce the rotor 202.

In some examples, portions of the cold sprayed coating 203 may be converted to metallurgical bonds at critical locations on the rotor 202. The critical locations may be locations that have a higher likelihood of experiencing damage such as cracking or flaking. For example, the coating 203 may be a tungsten carbine or a chromium carbide alloy with a self-fluxing alloy such as a nickel-based binder. After deposition via cold spraying, the critical locations can be fused to the base material or other coatings using an induction heating band. The metallurgical bonding of the coating 203 to the base material may increase the bond strength between the coating 203 and the base material, without increasing the likelihood for the coating 203 to experience corrosion or cracking.

In some examples, after a coating 203 has been deposited onto the base material of the rotor 202 via cold spraying, the rotor 202 may be polished to decrease resistance between the rotor 202 and the stator 204. Polishing may be a time-consuming process depending on the roughness of the coating 203. The amount of polishing required may depend on the particle size of the material for the coating 203. For example, coatings 203 with higher particle sizes may cause the rotor 202 to require more polishing to achieve a desired smoothness. Cold spraying may allow for relatively small particle sizes that can significantly reduce or prevent time spent on polishing. Examples of coating materials with small particle size can include nanostructured materials such as tungsten carbide or chromium carbide composites with nickel-based matrices.

Figure 3:
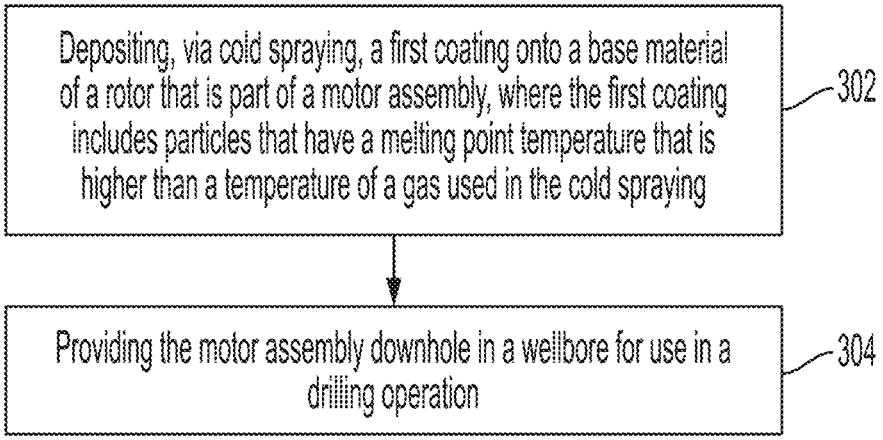
FIG. 3 is a flowchart of a method for cold spraying a coating onto a rotor of a motor assembly according to one example of the present disclosure.

FIG. 3 is a flowchart of a method for cold spraying a coating 203 onto a rotor 202 of a motor assembly 200 according to one example of the present disclosure. At block 302, a first coating is deposited via cold spraying onto a base material of a rotor 202 that is part of a motor assembly 200. The first coating can include sprayed particles that have a melting point temperature that is higher than a temperature of a gas used in the cold spraying. The particles may be solid powder particles ranging from 1 to 50 micrometers in diameter. The temperature of the cold spraying may therefore be dependent on the melting point of the particles. In some examples, the velocity of the cold spraying can be up to 1200 m/s. The particles may be cold sprayed, such as from a nozzle of a supersonic gas jet, along the base material of the rotor 202. The kinetic energy of the particles during the cold spraying may be converted to plastic deformation energy to bond to the base material of the rotor 202. Unlike in other thermal spraying techniques such as HVOF spraying, the particles may not be melted during the spraying process.

In some examples, the first coating may include additives such as solid lubricants or conducting materials. The additives may be included to enhance various properties of the rotor 202 and can be deposited onto the base material while maintaining the properties due to the colder temperatures of the cold spraying process. In some examples, rather than being incorporated into the first coating, the additives may be cold sprayed onto the base material substantially contemporaneously with the first coating.

In some examples, the size of the solid powder particles may be selected to be relatively small in order to reduce polishing of the rotor 202 after coating. The density and thickness of the coating 203 may also be varied. For example, the coating 203 may be cold sprayed to be thicker in areas that are determined to be more susceptible to damage. In some examples, the coating 203 may be cold sprayed to have a porosity of less than 1.0% by volume. In other examples, the coating 203 may be cold sprayed to have a porosity (percent by volume) of from 0.5% to 1.0%, from 1.0% to 1.5%, from 1.5% to 2.0%, from 2.0% to 2.5%, or from 2.5% to 3.0%. Additionally, the coating 203 may be cold sprayed such that there is a gradient of porosities within the coating 203. For example, portions of the coating 203 closer to the base material may have a lower porosity than portions of the coating 203 farther from the base material.

In some examples, additional coatings can be deposited on top of the first coating, such as a second coating. The second coating may be deposited via cold spraying or other thermal spraying techniques, such as via HVOF/HVAF spraying, onto the first coating. In some examples, a binder may be deposited via cold spray between the first coating and the second coating to bind the coatings together. In some examples, the additional coatings may include additives. Additional coatings may be deposited to further protect the base material of the rotor 202 from damage, reduce friction between the rotor 202 and the stator 204, and protect the stator 204 from thermal hysteresis.

In some examples, the first coating may be cold sprayed onto a damaged rotor to repair the rotor. The damaged rotor may have a coating that was not cold sprayed onto base material. The first coating may be deposited via cold spraying onto exposed base material and corroded coating to repair the damaged rotor. In this manner, damaged rotors that may have been scrapped due to an inability to be repaired using other techniques can be repaired for use in the wellbore 106, extending the lifetime of the motor assembly 200. In some examples, after cold spraying the first coating and any additional coatings onto the base material of the rotor 202, portions of the coating 203 may be metallurgically bonded using self-fluxing binders.

At block 304, the motor assembly is provided downhole in a wellbore 106 for use in a drilling operation. For example, the motor assembly 200 may be part of a drilling system. The rotor 202 may turn within the motor assembly 200 to provide power to a drill bit for drilling a wellbore. In some examples, the cold sprayed coating 203 on the rotor 202 of the motor assembly 200 may protect the rotor 202 from corrosive fluids in the downhole environment. Decreasing exposure of the base material to downhole fluids may extend the lifetime of the rotor 202 and motor assembly 200 by reducing necessary repairs. When the rotor 202 does require repairs, cold spraying techniques may be utilized to repair the rotor 202 without decreasing the effectiveness or durability of the rotor 202, and without increasing the likelihood of future damage to the rotor 202.

In some aspects, assembly, method, and system for a coating that is cold sprayed onto a rotor of a downhole motor assembly are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a motor assembly comprising: a stator comprising an elastomeric material; and a rotor positionable within the stator comprising: a base material; and a first coating deposited onto the base material via cold spraying for reducing damage to the rotor, the first coating comprising sprayed particles having a melting point temperature that is higher than a temperature of a gas used in the cold spraying, wherein the motor assembly is positionable downhole in a wellbore.

Example 2 is the motor assembly of Example 1, wherein the rotor further comprises: a second coating deposited onto the first coating via cold spraying, high velocity oxygen fuel spraying, or high velocity air fuel spraying.

Example 3 is the motor assembly of Example(s) 1-2, wherein the first coating comprises a nickel alloy or a titanium alloy and the second coating comprises a ceramic metal matrix composite, and wherein the first coating has a first hardness that is less than a second hardness of the second coating.

Example 4 is the motor assembly of Example(s) 1-3, wherein the rotor further comprises a binder between the first coating and the second coating for binding the first coating to the second coating, and wherein the binder comprises a metal alloy.

Example 5 is the motor assembly of Example(s) 1-4, wherein the first coating is a ceramic metal matrix composite.

Example 6 is the motor assembly of Example(s) 1-5, wherein the first coating further comprises a solid lubricant comprising at least one of tungsten sulfide, tungsten disulfide, graphite, molybdenum disulphide, or boron nitride.

Example 7 is the motor assembly of Example(s) 1-6, wherein the solid lubricant comprises from 1.0 wt. % to 10.0 wt. % of the first coating.

Example 8 is the motor assembly of Example(s) 1-7, wherein the first coating further comprises a conducting material comprising at least one of copper, silver, graphene, or carbon nanotube.

Example 9 is the motor assembly of Example(s) 1-8, wherein the conducting material comprises from 1.0 wt. % to 5.0 wt. % of the first coating.

Example 10 is a method comprising: depositing, via cold spraying, a first coating onto a base material of a rotor, the rotor being part of a motor assembly including a stator surrounding the rotor, the first coating including sprayed particles having a melting point temperature that is higher than a temperature of a gas used in the cold spraying; and providing the motor assembly downhole in a wellbore for use in a drilling operation.

Example 11 is the method of Example(s) 10, further comprising: depositing a second coating onto the first coating via cold spraying, high velocity oxygen fuel spraying, or high velocity air fuel spraying.

Example 12 is the method of Example(s) 10-11, wherein the first coating includes a nickel alloy or a titanium alloy and the second coating includes a ceramic metal matrix composite, and wherein the first coating has a first hardness that is less than a second hardness of the second coating.

Example 13 is the method of Example(s) 11-12, further comprising: prior to depositing the second coating onto the first coating, depositing a binder onto the first coating for binding the first coating to the second coating, the binder being a metal alloy.

Example 14 is the method of Example(s) 10-13, wherein the first coating is a ceramic metal matrix composite.

Example 15 is the method of Example(s) 10-14, wherein the first coating includes a solid lubricant comprising at least one of tungsten sulfide, tungsten disulfide, graphite, molybdenum disulphide, or boron nitride.

Example 16 is the method of Example(s) 10-15, wherein the solid lubricant comprises from 1.0 wt. % to 10.0 wt. % of the first coating.

Example 17 is the method of Example(s) 10-16, wherein the first coating includes a conducting material comprising at least one of copper, silver, graphene, or carbon nanotube.

Example 18 is the method of Example(s) 1-017, wherein the conducting material comprises 1.0 wt. % to 5.0 wt. % of the first coating.

Example 19 is a system comprising: a motor assembly positionable downhole in a wellbore comprising: a stator comprising an elastomeric material; and a rotor positionable within the stator comprising: a base material; and a first coating deposited onto the base material via cold spraying for reducing damage to the rotor, the first coating comprising sprayed particles having a melting point temperature that is higher than a temperature of a gas used in the cold spraying.

Example 20 is the system of Example(s) 19, wherein the rotor further comprises: a second coating deposited onto the first coating via cold spraying, high velocity oxygen fuel spraying, or high velocity air fuel spraying.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A motor assembly comprising:

a stator comprising an elastomeric material; and a rotor positionable within the stator comprising:

a base material; and a first coating deposited onto the base material via cold spraying for reducing damage to the rotor, the first coating comprising sprayed particles having a melting point temperature that is higher than a temperature of a gas used in the cold spraying, wherein the first coating further comprises a conducting material comprising at least one of copper, silver, graphene, or carbon nanotube, wherein the conducting material comprises from 1.0 wt. % to 5.0 wt. % of the first coating, and wherein the motor assembly is positionable downhole in a wellbore.

2. The motor assembly of claim 1, wherein the rotor further comprises:

a second coating deposited onto the first coating via cold spraying, high velocity oxygen fuel spraying, or high velocity air fuel spraying.

3. The motor assembly of claim 2, wherein the first coating comprises a nickel alloy or a titanium alloy and the second coating comprises a ceramic metal matrix composite, and wherein the first coating has a first hardness that is less than a second hardness of the second coating.

4. The motor assembly of claim 2, wherein the rotor further comprises a binder between the first coating and the second coating for binding the first coating to the second coating, and wherein the binder comprises a metal alloy.

5. The motor assembly of claim 1, wherein the first coating is a ceramic metal matrix composite.

6. The motor assembly of claim 1, wherein the first coating further comprises a solid lubricant comprising at least one of tungsten sulfide, tungsten disulfide, graphite, molybdenum disulphide, or boron nitride.

7. The motor assembly of claim 6, wherein the solid lubricant comprises from 1.0 wt. % to 10.0 wt. % of the first coating.

8. A method comprising:

depositing, via cold spraying, a first coating onto a base material of a rotor, the rotor being part of a motor assembly including a stator surrounding the rotor, the first coating including sprayed particles having a melting point temperature that is higher than a temperature of a gas used in the cold spraying, wherein the first coating includes a conducting material comprising at least one of copper, silver, graphene, or carbon nanotube, and wherein the conducting material comprises 1.0 wt. % to 5.0 wt. % of the first coating; and providing the motor assembly downhole in a wellbore for use in a drilling operation.

9. The method of claim 8, further comprising:

depositing a second coating onto the first coating via cold spraying, high velocity oxygen fuel spraying, or high velocity air fuel spraying.

10. The method of claim 9, wherein the first coating includes a nickel alloy or a titanium alloy and the second coating includes a ceramic metal matrix composite, and wherein the first coating has a first hardness that is less than a second hardness of the second coating.

11. The method of claim 9, further comprising:

prior to depositing the second coating onto the first coating, depositing a binder onto the first coating for binding the first coating to the second coating, the binder being a metal alloy.

12. The method of claim 8, wherein the first coating is a ceramic metal matrix composite.

13. The method of claim 8, wherein the first coating includes a solid lubricant comprising at least one of tungsten sulfide, tungsten disulfide, graphite, molybdenum disulphide, or boron nitride.

14. The method of claim 13, wherein the solid lubricant comprises from 1.0 wt. % to 10.0 wt. % of the first coating.

15. A system comprising:

a motor assembly positionable downhole in a wellbore comprising:

a stator comprising an elastomeric material; and a rotor positionable within the stator comprising:

a base material; and a first coating deposited onto the base material via cold spraying for reducing damage to the rotor, the first coating comprising sprayed particles having a melting point temperature that is higher than a temperature of a gas used in the cold spraying, wherein the first coating further comprises a conducting material comprising at least one of copper, silver, graphene, or carbon nanotube, and wherein the conducting material comprises from 1.0 wt. % to 5.0 wt. % of the first coating.

16. The system of claim 15, wherein the rotor further comprises:

a second coating deposited onto the first coating via cold spraying, high velocity oxygen fuel spraying, or high velocity air fuel spraying.

17. The system of claim 16, wherein the first coating further comprises a nickel alloy or a titanium alloy and the second coating comprises a ceramic metal matrix composite, and wherein the first coating has a first hardness that is less than a second hardness of the second coating.

18. The system of claim 16, wherein the rotor further comprises a binder between the first coating and the second coating for binding the first coating to the second coating, and wherein the binder comprises a metal alloy.

19. The system of claim 15, wherein the first coating is a ceramic metal matrix composite.

20. The system of claim 15, wherein the first coating further comprises a solid lubricant comprising at least one of tungsten sulfide, tungsten disulfide, graphite, molybdenum disulphide, or boron nitride.

* * * * *